US006067690A

United States Patent [19]

Herman

[11] Patent Number: 6,067,690

[45] Date of Patent: May 30, 2000

[54] DEVICE FOR ATTACHING TO A SLIDING DOOR AND FOR ALLOWING OPENING OF THE SLIDING DOOR BY USE OF A FOOT

[76] Inventor: Kenneth J. Herman, 151 Dixon Ave., Amityville, N.Y. 11701

[21] Appl. No.: 09/203,886

[22] Filed: Dec. 2, 1998

[51] Int. Cl.[7] ..... E05B 1/00; B05C 21/02

[52] U.S. Cl. ..... 16/412; 16/901; 49/460; 292/342; 292/DIG. 46

[58] Field of Search ..... 16/110.1, 412, 16/413, 436, 901; 49/460; 292/343, 342, 292, DIG. 46

[56] References Cited

U.S. PATENT DOCUMENTS

| | | | |
|---|---|---|---|
| 0,642,661 | 2/1900 | Adams | 16/901 |
| 0,842,081 | 1/1907 | Clark | 16/901 |
| 0,972,773 | 10/1910 | Millsaps | 16/412 |
| 1,337,384 | 4/1920 | Allen | 16/901 |
| 2,373,858 | 4/1945 | Solyst | 49/460 |
| 3,156,944 | 11/1964 | Bohn | 16/412 |
| 3,222,732 | 12/1965 | Miller | 49/460 |
| 4,087,141 | 5/1978 | Roberts | 16/412 |
| 4,569,546 | 2/1986 | Howard et al. | 292/336.3 |
| 5,102,173 | 4/1992 | Schallern | 292/DIG. 46 |
| 5,193,863 | 3/1993 | McBain | 292/255 |
| 5,469,661 | 11/1995 | Finkelstein et al. | 49/276 |
| 5,622,416 | 4/1997 | Rainey et al. | 312/319.9 |

*Primary Examiner*—Chuck Y. Mah
*Assistant Examiner*—Donald M. Gurley
*Attorney, Agent, or Firm*—Richard L. Miller, P.E., Registered Patent Agent

[57] ABSTRACT

A device for attaching to a sliding door of a pair of sliding doors and for allowing opening of the sliding door by use of a foot. The device includes a first portion, a second portion, and attaching apparatus. The first portion is attached to the interior surface of the bottom of the sliding door and is engaged by the foot when opening the sliding door. The second portion is attached to the exterior surface of the bottom of the sliding door and is engaged by the foot when opening the sliding door. The attaching apparatus attaches the first portion and the second portion to the sliding door. The second portion has a proximal part, an intermediate part that is prismatically-shaped and extends integrally taperingly outwardly from the proximal part, and a distal part that extends integrally outwardly from, and is thinner than, the intermediate part to a distal end surface of the second portion, where it assumes a cylindrical shape that is vertically-oriented and extends laterally slightly past the distal part to prevent injury to the foot accidentally contacting it.

14 Claims, 1 Drawing Sheet

DEVICE FOR ATTACHING TO A SLIDING DOOR AND FOR ALLOWING OPENING OF THE SLIDING DOOR BY USE OF A FOOT

BACKGROUND OF THE INVENTION

1. Field of the Invention

The present invention relates to a device for attaching to a sliding door. More particularly, the present invention relates to a device for attaching to a sliding door and for allowing opening of the sliding door by use of a foot.

2. Description of the Prior Art

Numerous innovations for foot operated door openers have been provided in the prior art that will be described. Even though these innovations may be suitable for the specific individual purposes to which they address, however, they differ from the present invention.

A FIRST EXAMPLE, U.S. Pat. No. 4,569,546 to Howard et al. teaches a pedal that is secured to the bottom of a door and a clamp that is secured to the door knob. The pedal is coupled to the clamp through a cord or the like. Operation of the pedal by a user turns the knob through the clamp, whereby the door latch is disengaged from a latch plate in the door jamb to free the door therefrom, so that the door may be opened by the user by pushing with a hand or foot, as the case may be.

A SECOND EXAMPLE, U.S. Pat. No. 5,193,863 to McBain teaches a foot activated door opening device that can be readily retrofitted onto existing doors, especially doors of walk-in type refrigerators. The device includes a lever system that can be readily adjusted to accommodate different size handles. When activated by a foot pedal, the lever system engages the handle which cause the door to open. In another aspect of the invention, a device that is particularly suited for opening a door equipped with a plunger mechanism is provided. The device is foot activated and uses a lever system to engage the plunger.

A THIRD EXAMPLE, U.S. Pat. No. 5,469,661 to Finkelstein et al. teaches a foot treadle for use in opening a sliding door of the type mounted for initial movement in three directional dimensions from its closed position comprises a lever having an axis of rotation. The lever has a leg that depends generally downwardly from the axis and an arm that extends generally laterally from the axis. A pedal is mounted to the arm distally from the axis of rotation. The lever is mounted to a door jamb of a sliding door with the lever leg closely adjacent a lower end of the door for pivotal movement about the lever axis of rotation in pushing and sliding engagement with the door lower end. Upon a person stepping upon the pedal the lever leg applies a force laterally and upwardly against the door lower end thereby urging the door laterally and upwardly out of sealed engagement with the door jamb and floor as the door lower end slides outwardly from the door jamb in sliding contact with the lever leg.

A FOURTH EXAMPLE, U.S. Pat. No. 5,622,416 to Rainey et al. teaches a foot pedal door opener device for side-by-side doors of a cabinet that includes a right side foot pedal for opening a left side door of the side-by-side doors, and a left side foot pedal for opening a right side door of the side-by-side doors. The right and left side foot pedals are pivotably attached to pivot points on the cabinet. Actuator members are fixedly attached to the right and left side foot pedals. The actuator members are disposed to engage the opposite doors when a foot pedal is actuated, thereby opening the opposite door. The actuator members extend from one foot pedal toward the other foot pedal, such that a portion of the actuator members are in an overlapping, non-interfering relationship.

It is apparent that numerous innovations for foot operated door openers have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a device for attaching to a sliding door and for allowing opening of the sliding door by use of a foot that avoids the disadvantages of the prior art.

ANOTHER OBJECT of the present invention is to provide a device for attaching to a sliding door and for allowing opening of the sliding door by use of a foot that is simple and inexpensive to manufacture.

STILL ANOTHER OBJECT of the present invention is to provide a device for attaching to a sliding door and for allowing opening of the sliding door by use of a foot that is simple to use.

BRIEFLY STATED, YET ANOTHER OBJECT of the present invention is to provide a device for attaching to a sliding door of a pair of sliding doors and for allowing opening of the sliding door by use of a foot. The device includes a first portion, a second portion, and attaching apparatus. The first portion is attached to the interior surface of the bottom of the sliding door and is engaged by the foot when opening the sliding door. The second portion is attached to the exterior surface of the bottom of the sliding door and is engaged by the foot when opening the sliding door. The attaching apparatus attaches the first portion and the second portion to the sliding door. The second portion has a proximal part, an intermediate part that is prismatically-shaped and extends integrally taperingly outwardly from the proximal part, and a distal part that extends integrally outwardly from, and is thinner than, the intermediate part to a distal end surface of the second portion, where it assumes a cylindrical shape that is vertically-oriented and extends laterally slightly past the distal part to prevent injury to the foot accidentally contacting it.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 1:
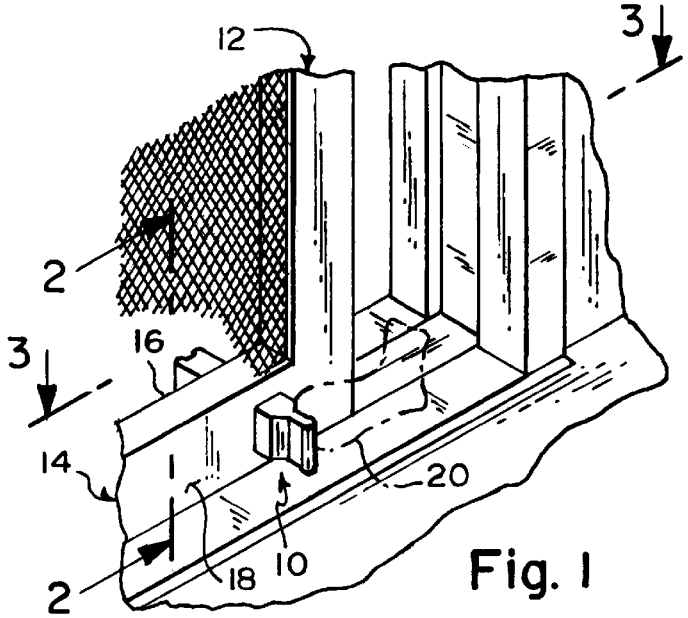
FIG. 1 is a diagrammatic perspective view of the present invention installed on a sliding door.

10 device for attaching to a sliding door and for allowing opening of the sliding door by use of a foot of the present invention

12 sliding door
14 bottom of sliding door 12
16 interior surface of bottom 14 of sliding door 12
18 exterior surface of bottom 14 of sliding door 12
20 foot
22 first portion for attaching to interior surface 16 of bottom 14 of sliding door 12 and for being engaged by foot 20 for opening sliding door 12
24 second portion for attaching to exterior surface 18 of bottom 14 of sliding door 12 and for being engaged by foot 20 for opening sliding door 12
26 attaching apparatus for attaching first portion 22 to interior surface 16 of bottom 14 of sliding door 12 and second portion 24 to exterior surface 18 of bottom 14 of sliding door 12
28 proximal end surface of first portion 22 for contacting interior surface 16 of bottom 14 of sliding door 12
30 distal end surface of first portion 22
32 central slot in distal end surface 30 of first portion 22
33 pair of remaining surfaces of distal end surface 30 of first portion 22
34 pair of throughbores in first portion 22
36 proximal end surface of second portion 24 for contacting exterior surface 18 of bottom 14 of sliding door 12
38 distal end surface of second portion 24
40 pair of blindbores in second portion 24
42 pair of screws of attaching apparatus 26
44 heads of pair of screws 42 of attaching apparatus 26
46 proximal part of second portion 24
48 intermediate part of second portion 24
50 distal part of second portion 24
52 beam for removably wedging horizontally between first portion 22 and other sliding door of pair of sliding doors for preventing undesirable opening of sliding door 12

DETAILED DESCRIPTION OF THE PREFERRED EMBODIMENT

Referring now to the figures, in which like numerals indicate like parts, and particularly to FIG. 1, the device for attaching to a sliding door and for allowing opening of the sliding door by use of a foot of the present invention is shown generally at 10 for attaching to a sliding door 12 of a pair of sliding doors that has a bottom 14 with an interior surface 16 and an exterior surface 18 and for allowing opening of the sliding door 12 by use of a foot 20.

Figure 2:
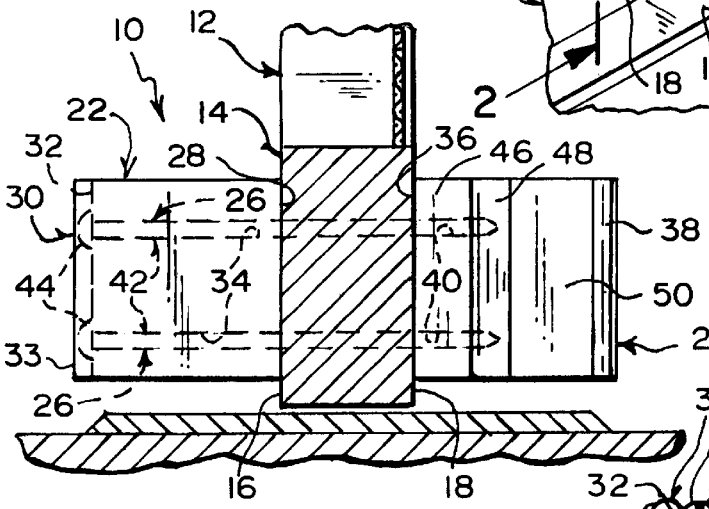
FIG. 2 is an enlarged diagrammatic cross sectional view taken on line 2—2 in FIG. 1.
Figure 3:
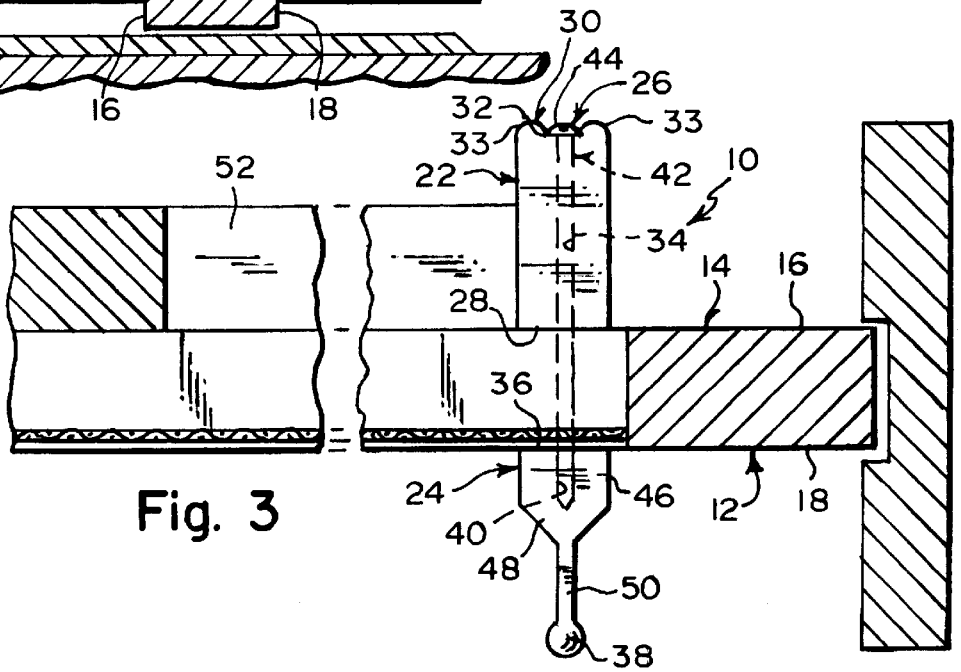
FIG. 3 is an enlarged diagrammatic cross sectional view taken on line 3—3 in FIG. 1.

The configuration of the device for attaching to a sliding door and for allowing opening of the sliding door by use of a foot 10 can best be seen in FIGS. 2 and 3, and as such, will be discussed with reference thereto.

The device for attaching to a sliding door and for allowing opening of the sliding door by use of a foot 10 comprises a first portion 22 for attaching to the interior surface 16 of the bottom 14 of the sliding door 12 and for being engaged by the foot 20 for opening the sliding door 12.

The device for attaching to a sliding door and for allowing opening of the sliding door by use of a foot 10 further comprises a second portion 24 for attaching to the exterior surface 18 of the bottom 14 of the sliding door 12 and for being engaged by the foot 20 for opening the sliding door 12.

The device for attaching to a sliding door and for allowing opening of the sliding door by use of a foot 10 further comprises attaching apparatus 26 for attaching the first portion 22 to the interior surface 16 of the bottom 14 of the sliding door 12 and the second portion 24 to the exterior surface 18 of the bottom 14 of the sliding door 12.

The first portion 22 is a block that is generally rectangular-parallelepiped-shaped, vertically-oriented, and thin, and has a proximal end surface 28 for contacting the interior surface 16 of the bottom 14 of the sliding door 12 and a distal end surface 30 that is disposed opposite the proximal end surface 28 of the first portion 22.

The distal end surface 30 of the first portion 22 has a central slot 32 that extends vertically completely therealong and a pair of remaining surfaces 33 that extend vertically completely therealong and are convex-shaped in lateral profile and raised above, and straddle, the central slot 32 in the distal end surface 30 of the first portion 22.

The first portion 22 further has a pair of throughbores 34 that are parallel to each other, vertically spaced-apart, and extend horizontally therethrough, from the central slot 32 in the distal end surface 30 of the first portion 22, to the proximal end surface 28 of the first portion 22.

The second portion 24 is a block that is vertically-oriented, and thin, and has a proximal end surface 36 that is in alignment with the proximal end surface 28 of the first portion 22 for contacting the exterior surface 18 of the bottom 14 of the sliding door 12 and a distal end surface 38 that is disposed opposite the proximal end surface 36 of the second portion 24.

The second portion 24 further has a pair of blindbores 40 that are parallel to each other, vertically spaced-apart, in alignment with the pair of throughbores 34 in the first portion 22, and extend horizontally and partially therein, from the proximal end surface 36 of the second portion 24.

The attaching apparatus 26 comprises a pair screws 42 that have heads 44.

The pair of screws 42 of the attaching apparatus 26 extend, respectively, through the pair of throughbores 34 in the first portion 22, through the bottom 14 of the sliding door 12, and threadably engage in the pair of blindbores 40 in the second portion 24, with the heads 44 of the pair of screws 42 of the attaching apparatus 26 being craddlingly recessed in the central slot 32 in the distal end surface 30 of the first portion 22 for preventing contact by the foot, and with the convex-shape of the remaining surfaces 33 of the distal end surface 30 preventing injury to the foot accidentally contacting it.

The second portion 24 has a proximal part 46 that is rectangular-parallelepiped-shaped, vertically-oriented, and as thin as the first portion 22, and extends integrally outwardly from the proximal end surface 36 of the second portion 24.

The second portion 24 further has an intermediate part 48 that is prismatically-shaped, vertically-oriented, and extends integrally taperingly outwardly from the proximal part 46 of the second portion 24.

The second portion 24 further has a distal part 50 that is rectangular-parallelepiped-shaped, vertically-oriented, and extends integrally outwardly from, and is thinner than, the intermediate part 48 of the second portion 24 to the distal end surface 38 of the second portion 24, where it assumes a cylindrical shape that is vertically-oriented and extends laterally slightly past the distal part 50 of the second portion 24 for preventing injury to the foot accidentally contacting it.

The second portion 24 is slightly resilient and in conjunction with the thinner shape of the distal part 50 of the second portion 24 allows the distal part 50 of the second portion 24 to slightly flex if the foot accidentally gets caught thereon.

The device for attaching to a sliding door and for allowing to opening of the sliding door by use of a foot 10 further comprises a beam 52 for removably wedging horizontally between the first portion 22 and the other sliding door of the pair of sliding doors for preventing undesirable opening of the sliding door 12.

It will be understood that each of the elements described above, or two or more together, may also find a useful application in other types of constructions differing from the types described above.

While the invention has been illustrated and described as embodied in a device for attaching to a sliding door and for allowing opening of the sliding door by use of a foot, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A device for attaching to a sliding door of a pair of sliding doors that has a bottom with an interior surface and an exterior surface and for allowing opening of the sliding door by use of a foot, said device comprising;

a) a first portion for attaching to the interior surface of the bottom of the sliding door and for being engaged by the foot for opening the sliding door; and b) a beam for removably wedging horizontally between said first portion and the other sliding door of the pair of sliding door for preventing undesirable opening of the sliding door.

2. The device as defined in claim 1; further comprising a second portion for attaching to the exterior surface of the bottom of the sliding door and for being engaged by the foot for opening the sliding door.

3. The device as defined in claim 2; further comprising attaching apparatus for attaching said first portion to the interior surface of the bottom of the sliding door and said second portion to the exterior surface of the bottom of the sliding door.

4. The device as defined in claim 3, wherein said first portion is a block that is generally rectangular-parallelepiped-shaped, vertically-oriented, and thin, and has:

a) a proximal end surface for contacting the interior surface of the bottom of the sliding door; and b) a distal end surface that is disposed opposite said proximal end surface of said first portion.

5. The device as defined in claim 4, wherein said distal end surface of said first portion has:

a) a central slot that extends vertically completely therealong; and b) a pair of remaining surfaces that extend vertically completely therealong and are convex-shaped in lateral profile and raised above, and straddle, said central slot in said distal end surface of said first portion.

6. The device as defined in claim 5, wherein said first portion further has a pair of throughbores that are parallel to each other, vertically spaced-apart, and extend horizontally therethrough, from said central slot in said distal end surface of said first portion, to said proximal end surface of said first portion.

7. The device as defined in claim 6, wherein said second portion is a block that is vertically-oriented, and thin, and has:

a) a proximal end surface that is in alignment with said proximal end surface of said first portion for contacting the exterior surface of the bottom of the sliding door; and b) a distal end surface that is disposed opposite said proximal end surface of said second portion.

8. The device as defined in claim 7, wherein said second portion further has a pair of blindbores that are parallel to each other, vertically spaced-apart, in alignment with said pair of throughbores in said first portion, and extend horizontally and partially therein, from said proximal end surface of said second portion.

9. The device as defined in claim 8, wherein said attaching apparatus comprises a pair screws that have heads.

10. The device as defined in claim 9, wherein said pair of screws of said attaching apparatus extend, respectively, through said pair of throughbores in said first portion, through the bottom of the sliding door, and threadably engage in said pair of blindbores in said second portion, with said heads of said pair of screws of said attaching apparatus being craddlingly recessed in said central slot in said distal end surface of said first portion for preventing contact by the foot, and with said convex-shape of said remaining surfaces of said distal end surface preventing injury to the foot accidentally contacting it.

11. The device as defined in claim 7, wherein said second portion has a proximal part that is rectangular-parallelepiped-shaped, vertically-oriented, and as thin as said first portion, and extends integrally outwardly from said proximal end surface of said second portion.

12. The device as defined in claim 11, wherein said second portion further has an intermediate part that is prismatically-shaped, vertically-oriented, and extends integrally taperingly outwardly from said proximal part of said second portion.

13. The device as defined in claim 12, wherein said second portion further has a distal part that is rectangular-parallelepiped-shaped, vertically-oriented, and extends integrally outwardly from, and is thinner than, said intermediate part of said second portion to said distal end surface of said second portion, where it assumes a cylindrical shape that is vertically-oriented and extends laterally slightly past said distal part of said second portion for preventing injury to the foot accidentally contacting it.

14. The device as defined in claim 13, wherein said second portion is slightly resilient and in conjunction with said thinner shape of said distal part of said second portion allows said distal part of said second portion to slightly flex if the foot accidentally gets caught thereon.

* * * * *